US006524156B1

(12) United States Patent
Horchler et al.

(10) Patent No.: US 6,524,156 B1
(45) Date of Patent: Feb. 25, 2003

(54) TALKING STICK HORSE

(75) Inventors: Jack Horchler, Mokena, IL (US); Damian Mucaro, Wayne, NJ (US); Kevin Lai, Kowloon Bay (HK)

(73) Assignee: Tek Nek Toys International Inc., Mokena, IL (US)

( * ) Notice: Subject to any disclaimer, the term of this patent is extended or adjusted under 35 U.S.C. 154(b) by 0 days.

(21) Appl. No.: 09/968,069

(22) Filed: Oct. 1, 2001

(51) Int. Cl.[7] ..... A63H 33/00
(52) U.S. Cl. ..... 446/29; 472/98; 446/301
(58) Field of Search ..... 446/29, 330, 313, 446/331, 369, 397, 408, 411, 301; 434/322; 280/1.13, 1.14; 472/95–98

(56) References Cited

U.S. PATENT DOCUMENTS 3,201,117 A * 8/1965 Gursha
4,808,142 A * 2/1989 Berliner ..... 446/301
5,074,820 A * 12/1991 Nakayama ..... 446/29
5,100,362 A * 3/1992 Fogarty et al. ..... 446/272
5,145,447 A * 9/1992 Goldfarb ..... 446/408
5,279,514 A * 1/1994 Lacombe et al. ..... 446/297
5,316,515 A * 5/1994 Hyman et al. ..... 446/28
5,823,847 A * 10/1998 Gellman ..... 446/301
5,944,533 A * 8/1999 Wood ..... 434/322
6,315,631 B1 * 11/2001 Bechman et al. ..... 446/297

* cited by examiner

*Primary Examiner*—Derris H. Banks
*Assistant Examiner*—Jamila Williams
(74) *Attorney, Agent, or Firm*—Michael Best & Friedrich LLC

(57) ABSTRACT

An interactive ride-on toy, having a stuffed toy horse's head which includes ears, a movable mouth and is connected to a stick. One or more buttons, each with an icon depicting an image, is positioned on one or both ears of the horse's head. An electronically programmed chip responds to activation of the button to operate a speaker and a mechanism for moving the horse's mouth, the speaker playing sounds relating to the image depicted on each button.

26 Claims, 5 Drawing Sheets

TALKING STICK HORSE

FIELD OF THE INVENTION

The present invention relates to interactive toys for children that talk and sing, and in particular, to interactive ride-on toys such as stick horses.

BACKGROUND OF THE INVENTION

Ride-on toys, such as stick horses, are well known in the art and allow the child to pretend that he or she is riding an actual horse. Stick horses typically comprise a toy resembling a horse's head connected to one end of a rigid stick. The child "rides" the stick horse by straddling the stick while holding the head portion.

Stick horses and similar toys are useful for enhancing a child's motor skills, and developing the child's imagination. However, such toys have limited play value because they are essentially static. Thus, there is a need for stick horse or similar ride-on toy that can interact with a child to encourage creative play and add teaching value to the toy.

SUMMARY OF THE INVENTION

These needs and other needs are satisfied by the interactive ride-on toy of the present invention, comprising a stuffed toy animal's head connected to a riding member, such as a stick. The head includes a movable mouth, a nose, eyes and ears. At least one button is positioned on at least one ear, the button having an icon depicting an image. In a preferred embodiment, one ear contains two buttons and the other ear contains a single button. An electronically programmed chip responds to activation of the ear button(s) to operate a speaker to produce sounds relating to the image and to operate a mechanism for moving the mouth. Electrical power is supplied by a battery located in a compartment provided, e.g., in the back of the head, such as within the mane of the horse or pony. Where the riding member is a stick, it may comprise two or more parts to facilitate packaging. Where the animal is a play horse or pony, a mane of simulated horse hair is provided, together with a comb for combing the horse's or pony's mane.

DETAILED DESCRIPTION OF THE INVENTION

Figure 1:
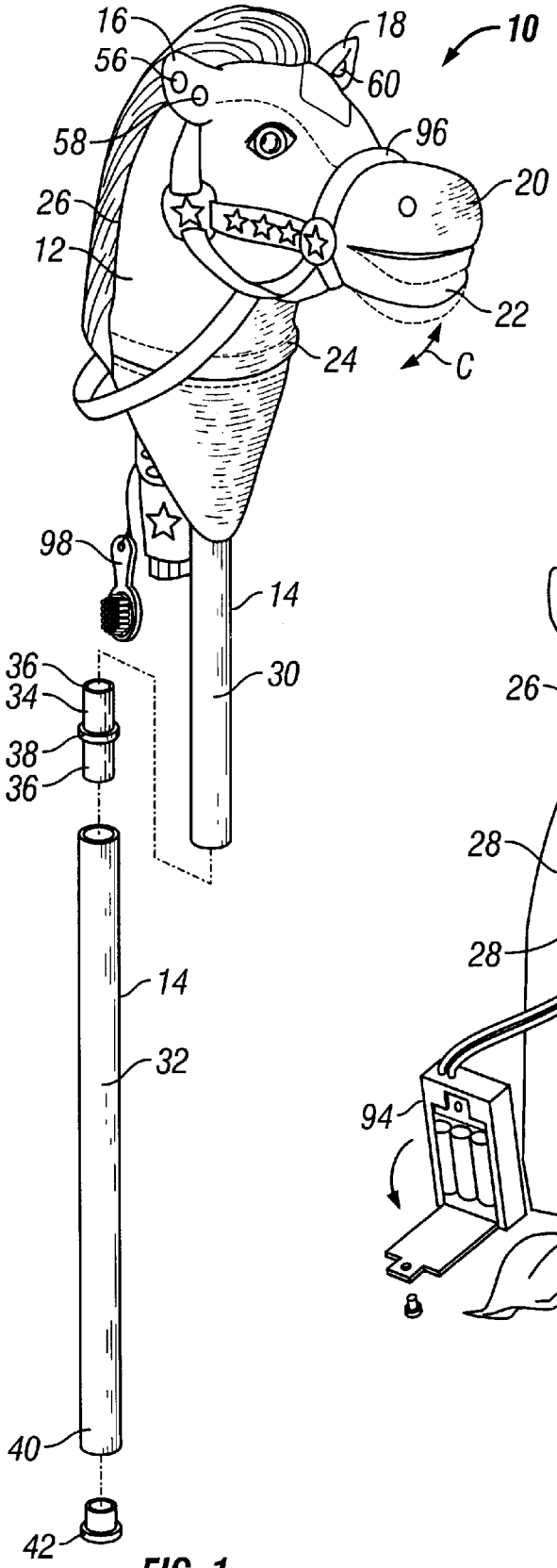
FIG. 1 is an exploded front perspective view of one embodiment of the present invention.
Figure 2:
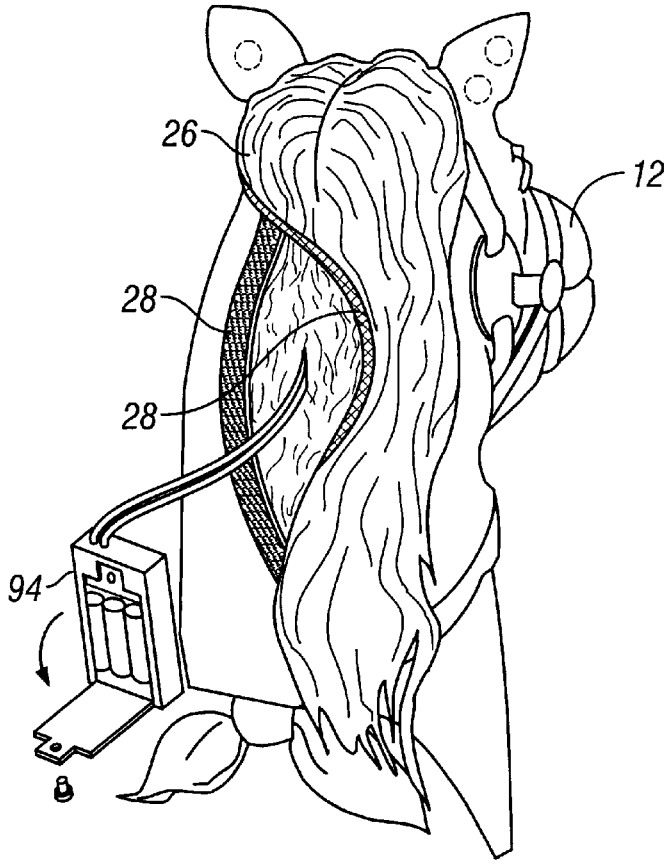
FIG. 2 is a partial rear perspective view of the head portion of the embodiment of FIG. 1, showing the battery compartment and battery.

In accordance with the present invention, an interactive stick horse or pony 10 is described, comprising a toy resembling a horse's head 12 that is connected to a riding member, such as a stick 14. As shown in FIG. 1, horse's head 12 is a stuffed toy, with left and right ears 16, 18, a movable mouth with upper and lower mouth portions 20, 22, and a rigid base 24. As shown in FIG. 2, a mane 26 conceals a closure 28 for accessing the interior of horse's head 12. In a preferred embodiment, closure 28 is a velcro strip.

Stick 14 is a two-piece hollow cylinder comprised of a short upper tube 30 and a longer lower tube 32. To facilitate packaging of stick horse 10, lower tube 22 has roughly the same length as height of upper tube 20 plus horse's head 12. Stick 14 is assembled from upper and lower tubes 30, 32 of by means of a connector 34, which consists of a pair of sleeves 36 positioned on either side of a spacer 38. Sleeves 36 are sized and shaped to fit within the inner circumference of upper and lower tubes 30, 32, and hold the two tubes together by friction.

As shown in FIG. 1, the bottom end 40 of lower tube 32 is provided with a friction fit cap 42. The top end 46 of upper tube 30 is connected to base 24 of horse's head 12. Base 24 is provided with a cylindrical collar 44 that has an inner circumference sized and shaped to receive top end 46 of upper tube 30. To secure upper tube 30 to collar 44, complementary openings 48, 50 are provided in top end 46 of upper tube 30 and in collar 44, respectively. Rivets 52 are inserted through both openings 48, 50 to fasten upper tube 30 to collar 44. As shown in FIG. 1, a decorative scarf 54 is attached to the base of horse's head 12 to conceal the connection between upper tube 30 and base 24.

Figure 4:
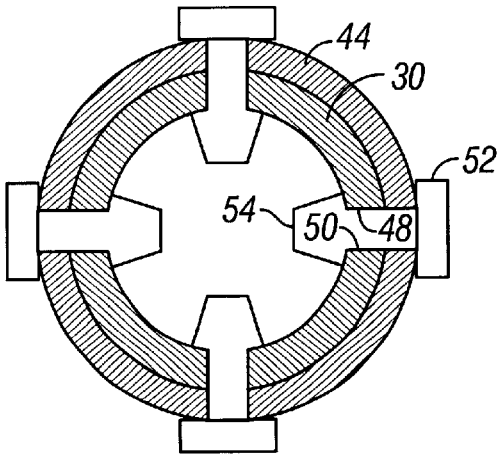
FIG. 4 is a section view taken along lines 4—4 of FIG. 3.

It is preferred to construct stick 14 and base 24 of a durable, lightweight material, such as plastic. As shown in FIG. 4, rivets 52 are similarly made of plastic and are provided with slotted, tapered ends 54, that may be compressed to permit rivets 52 to inserted through openings 48, 50. Once end 54 passes completely through openings 48, 50, end 54 expands to its original shape to hold rivet 52 in place and lock upper tube 30 to collar 44.

As shown in FIG. 1, left and right ears 16, 18 are provided with buttons 56, 58, 60, which mark the position of switches 56*a*, 58*a*, 60*a* (shown in FIG. 7) concealed within the ears. Depressing or squeezing buttons 56, 58, 60 activates the corresponding switches 56*a*, 58*a*, 60*a*, which causes a speaker 62 concealed within horse's head 12 to play a song, speak a phrase or make other sounds. In a preferred embodiment, buttons 56, 58, 60 are cloth patches embroidered with different icons depicting various images, such as a horse, a musical note or other design that relates to the sounds produced by activating that button.

For example, button 56 may have an icon depicting a horse's head and may be activated to play a short phrase, such as "let's go for a ride." Activating button 56 a second time may produce an alternate phrase, such as "I like it when you brush me." Button 58 may have an icon depicting a whole horse and may be activated to play the sound of a horse's neigh or galloping sounds. Button 60 may have an icon depicting a musical note and may be activated to play a song.

Figure 3:
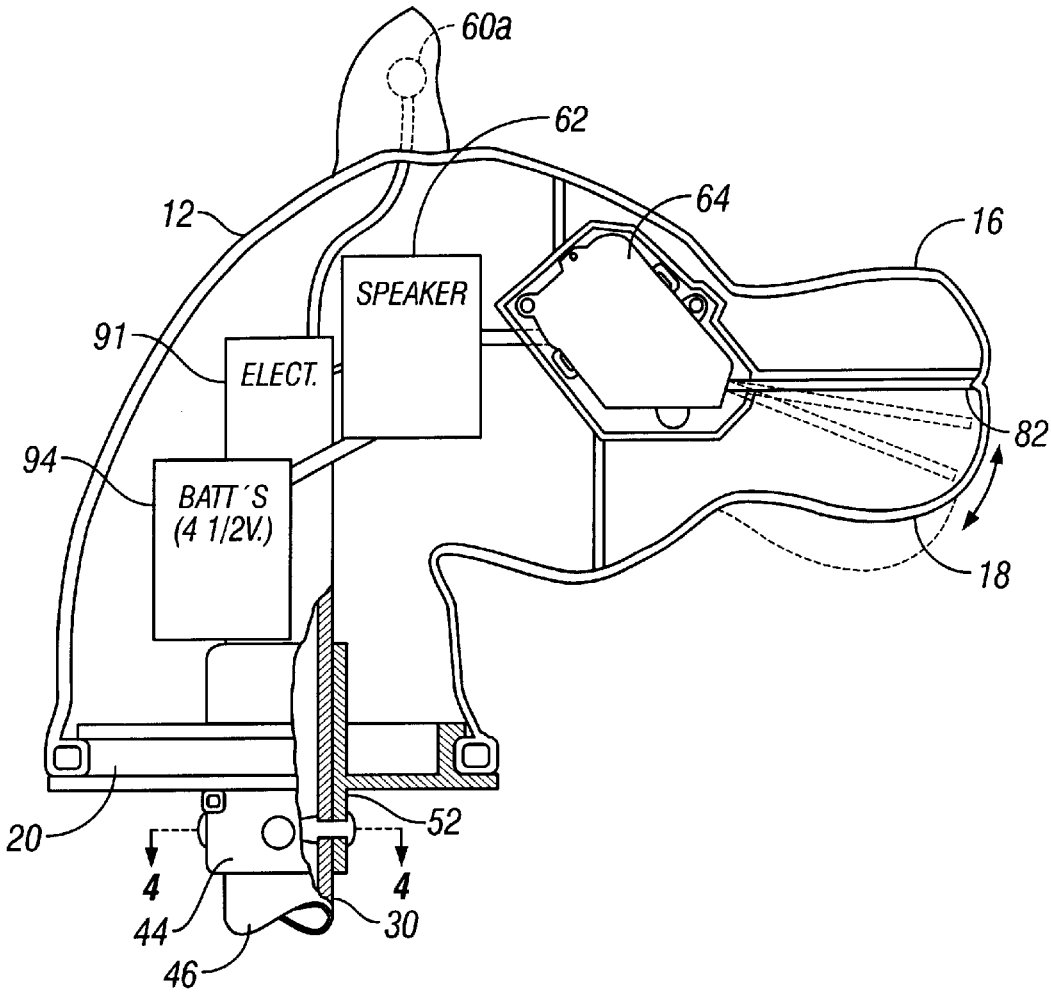
FIG. 3 is a side section view of the head portion of the embodiment of FIG. 1, schematically showing the electrical and mechanical parts.
Figure 5:
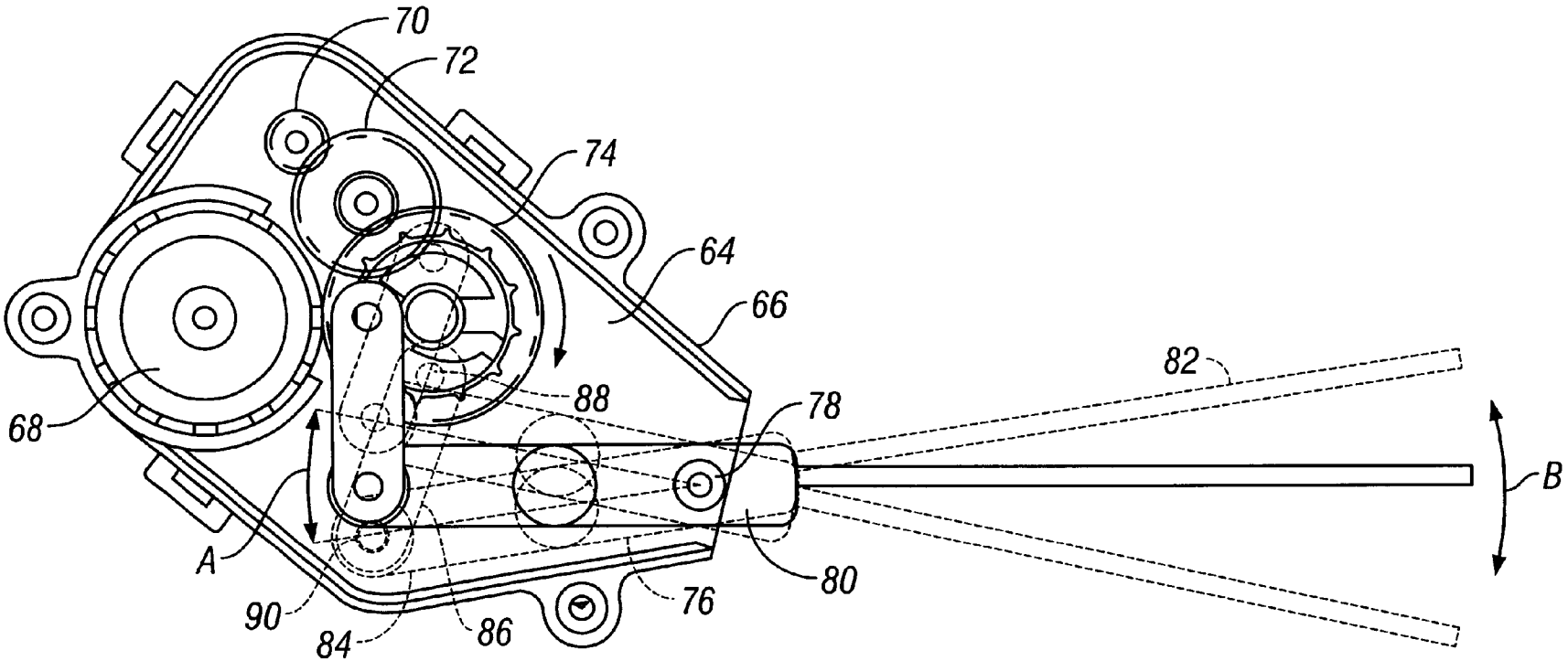
FIG. 5 is a side section view of the mouth operating mechanism of the embodiment of FIG. 1.
Figure 6:
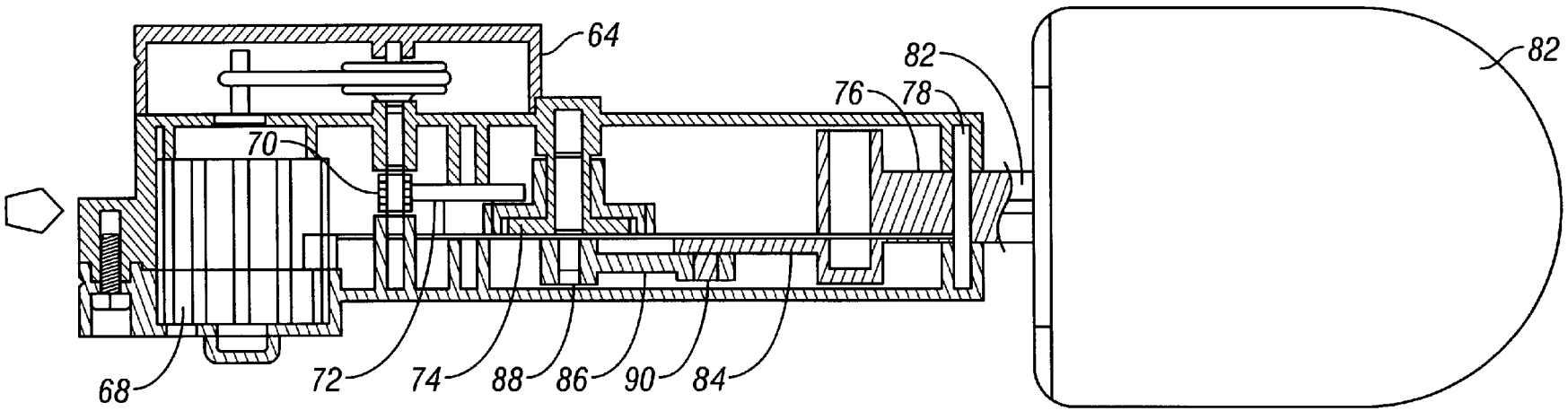
FIG. 6 is a top section view of the mechanism shown in FIG. 5.

In addition to playing sounds, the activation of buttons 56, 58, 60 also causes the horse's mouth to move while the sounds are being played. As shown in FIGS. 3, 5 and 6, horse's head 12 contains a gear box 64, that controls the up and down movement of lower mouth portion 22. Gear box 64 comprises a housing 66, which contains a motor 68 that drives a series of gears 70, 72, 74. An arm 76 is pivotally connected to gear box 64 at pivot 78. End 80 of arm 76 extends beyond gear box 64 and is connected to a plate 82, which is sized and shaped to fit within lower mouth portion 22. Opposite end 84 of arm 76 is connected to gear 74 through a push rod 86, which is pivotally connected to gear 74 at pivot 88 and arm 76 at pivot 90.

As shown in FIG. 5, the operation of motor 68 causes the rotation of gear 74, which raises and lowers push rod 86. The movement of push rod 86 raises and lowers end 84 of arm 76, causing arm 76 to rotate on pivot 78 through a short arc A. The rotation of arm 76 causes the up and down movement of plate 82 through an arc B, which results in the opening and closing movement of lower mouth portion 22 as shown by arrow C in FIGS. 1 and 3.

Figure 7:
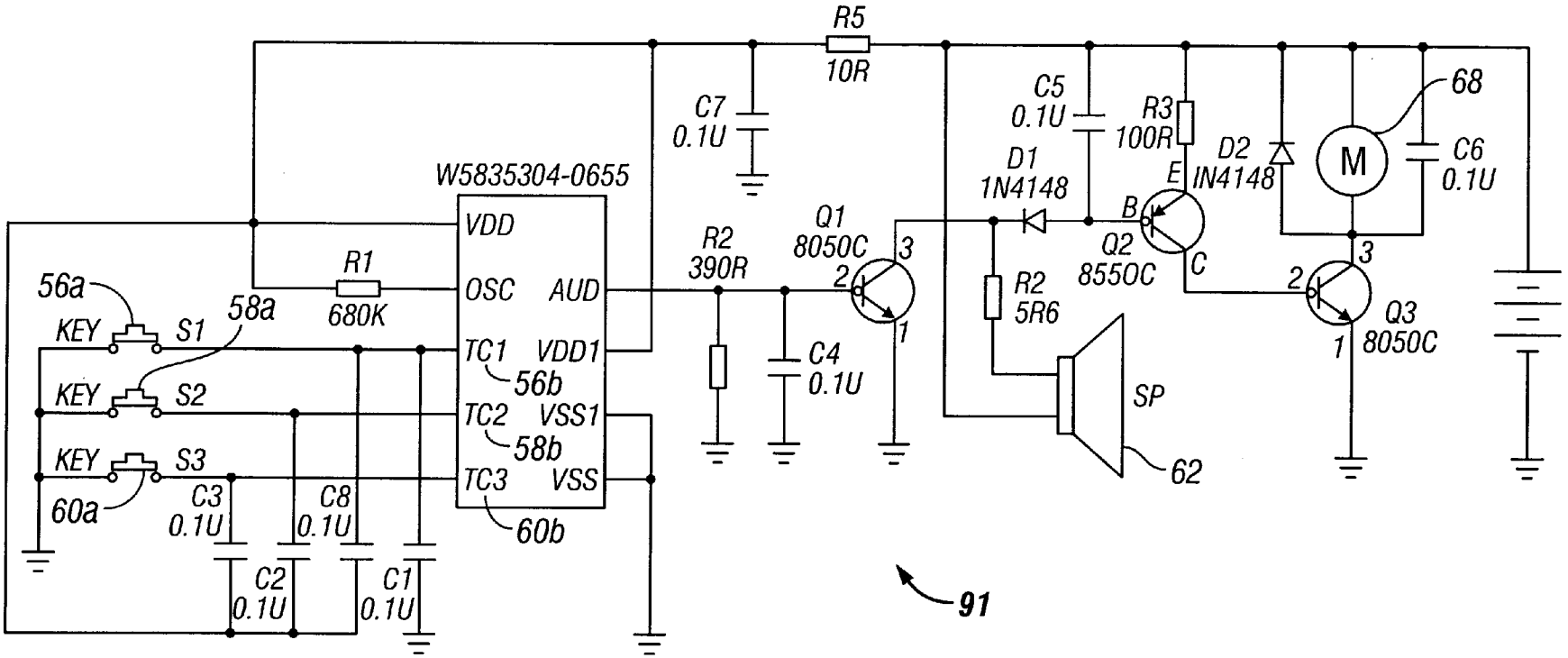
FIG. 7 is a circuit diagram of the control system of the embodiment of FIG. 1.

FIG. 7 depicts a general circuit diagram of the control system 91 of the present invention. The operation of the speaker 62 and gear box 64 is controlled by an electronically programmed chip 92 contained within horse's head 12, such as a W583 speech synthesizer chip (Winbond Electronics Corp., Taiwan). Depressing or squeezing buttons 56, 58, 60 actuates switches 56*a*, 58*a*, 60*a*, which send a signal to the corresponding trigger inputs 56*b*, 58*b*, 60*b*, directing chip 92 to actuate speaker 62 to play a preprogrammed sound or operate gear box motor 68 to move lower mouth portion 22.

A power supply of 4.5 V, 3 AA sized batteries, is required for operation of chip 92, speaker 62 and motor 68. As shown in FIG. 2, the batteries are stored in a battery compartment 94 concealed beneath mane 26 of horse's head 12, such that battery compartment 94 is readily accessible through closure 28, which may be a hook and loop fastener (such as Velcro), snaps, a zipper, or other suitable fastening closure means.

Although it is preferred that horse's head 12 is a stuffed toy, it will be understood by those of skill in the art that horse's head 12 may also be made of a rigid material, such as wood or plastic, having a hollow interior to accommodate the speaker, gear box, control system and batteries described above. The stick horse 10 may also be provided with various accessories to enhance interactive play, such as a bridle 96 and brush 98 (FIG. 1).

In addition to the stick horse 10 described above, the present invention is readily applied to rocking horses, spring horses, and other ride-on toys.

It will be apparent to those skilled in the art that changes and modifications may be made in the embodiments illustrated herein, without departing from the spirit and the scope of the invention. Thus, the invention is not to be limited to the particular forms herein shown and described except insofar as indicated by the scope of the appended claims.

What is claimed is:

1. An interactive ride-on toy, comprising:

a toy animal's head, having a movable mouth;

a riding member connected to said head;

at least one button on said head;

an electronically programmed chip for responding to activation of the button; and a speaker and a mechanism for moving said mouth located within the head, wherein the chip is programmed to operate both the speaker and the mechanism in response to activation of the button.

2. An interactive ride-on toy, comprising:

a toy animal's head, having a movable mouth;

a stick connected to said head;

at least one button on said head;

an electronically programmed chip for responding to activation of the button; and a speaker and a mechanism for moving said mouth located within the head, wherein the chip is programmed to operate both the speaker and the mechanism in response to activation of the button.

3. The interactive toy of claim 2, wherein the stick comprises two pieces adapted to interconnect, whereby packaging of the toy is facilitated.

4. The interactive toy of claim 2, wherein said head is a stuffed toy.

5. An interactive ride-on toy, comprising:

a toy animal's head, having a movable mouth and at least one ear;

is a riding member connected to said head;

at least one button on said ear;

an electronically programmed chip for responding to activation of the button; and a speaker and a mechanism for moving said mouth located within the head, wherein the chip is programmed to operate both the speaker and the mechanism in response to activation of the button.

6. An interactive ride-on toy, comprising:

a toy animal's head, having a movable mouth;

a riding member connected to said head;

at least one button on said head, wherein said button has an icon depicting an image;

an electronically programmed chip for responding to activation of the button; and a speaker and a mechanism for moving said mouth located within the head, wherein the chip is programmed to operate both the speaker and the mechanism in response to activation of the button, wherein the speaker produces sounds relating to said image.

7. The interactive toy of claim 6, wherein said image is a musical note and said chip is programmed to operate said speaker to play a song.

8. The interactive toy of claim 6, wherein said image is a horse and said chip is programmed to operate said speaker to play a horse's neigh.

9. The interactive toy of claim 6, wherein said image is a horse and said chip is programmed to operate said speaker to play galloping sounds.

10. The interactive toy of claim 6, wherein said image is a horse's head and said chip is programmed to operate said speaker to play a phrase.

11. An interactive ride-on toy, comprising:

a toy animal's head, having a movable mouth and two ears, wherein each ear has at least one button and each button has an icon depicting a different image;

a riding member connected to said head;

an electronically programmed chip for responding to activation of the button; and a speaker and a mechanism for moving said mouth located within the head, wherein the chip is programmed to operate both the speaker and the mechanism in response to activation of the button, wherein the speaker produces different sounds corresponding to each different image.

12. An interactive stick horse, comprising:

a head depicting a horse's head;

a movable mouth located on the head, the mouth comprising upper and lower members;

a stick connected to said head;

at least one button on said head, said button having an icon depicting an image;

an electronically programmed chip for responding to activation of said button; and a speaker and a mechanism for moving said mouth, said chip programmed to operate said speaker to produce sounds relating to said image and to operate said mechanism to move at least one member of said mouth in response to activation of said button.

13. The stick horse of claim 12, wherein the head has two ears, each ear has at least one button, each button having an icon thereon depicting an image, and the chip is programmed to operate the speaker to produce sounds relating to each image.

14. The stick horse of claim 13, wherein the head includes a compartment, and at least one battery located therein for generating electrical power to activate the chip and the mechanism for moving the mouth.

15. The stick horse of claim 14, wherein the mechanism for moving the mouth includes an electric motor, a series of gears driven by the motor, and a pivoting arm driven by the gears and connected to one of the upper and lower members of the mouth, causing that member to move in relation to the other.

16. The stick horse of claim 15 wherein the head is provided with a mane of simulated hair.

17. The interactive stick horse of claim 16, wherein said head is a stuffed toy, and the compartment is located within the mane and contains a closure having a hook and loop fastener that conceals the battery within the compartment.

18. The interactive stick horse of claim 17, wherein at least one image is a musical note and said chip is programmed to operate said speaker to play a song.

19. The interactive stick horse of claim 17, wherein at least one image is a horse and said chip is programmed to operate said speaker to play a horse's neigh.

20. The interactive stick horse of claim 17, wherein at least one image is a horse and said chip is programmed to operate said speaker to play galloping sounds.

21. The interactive stick horse of claim 17, wherein at least one image is a horse's head and said chip is programmed to operate said speaker to play a phrase.

22. The interactive stick horse of claim 17, wherein the stick has at least two parts adapted to fit together, whereby packaging of the stick horse is facilitated.

23. An interactive ride-on toy, comprising:

a toy figure having a movable mouth;

a stick connected to said figure;

at least one button on said figure, said button having an icon depicting an image;

an electronically programmed chip for responding to activation of said button; and a speaker and a mechanism for moving said mouth, said chip programmed to operate said speaker to produce sounds relating to said image and to operate said mechanism to move said mouth in response to activation of said button.

24. The interactive ride-on toy of claim 23, wherein the stick comprises two pieces adapted to interconnect.

25. The interactive ride-on toy of claim 23, wherein said figure has at least two buttons, each button having an icon depicting a different image, and said chip is programmed to operate the speaker to produce different sounds corresponding to each different image.

26. The interactive ride-on toy of claim 23, wherein said image is a musical note and said chip is programmed to operate said speaker to play a song.

* * * * *